United States Patent [19]

Lippmann

[11] 4,274,250

[45] Jun. 23, 1981

[54] PROCESS AND ARRANGEMENT FOR THE COVERING OF A SPINNING CARRIER WITH FIBER MATERIAL

[76] Inventor: Peter Lippmann, Gassner Feld 15, D-8212 Ubersee am Chiemsee, Fed. Rep. of Germany

[21] Appl. No.: 56,621

[22] Filed: Jul. 11, 1979

[30] Foreign Application Priority Data

Jul. 12, 1978 [DE] Fed. Rep. of Germany ..... 2830669

[51] Int. Cl.[3] ..... D02G 3/36; D01H 1/12

[52] U.S. Cl. ..... 57/5; 57/58.89; 57/327

[58] Field of Search ..... 57/5, 6, 58.89, 58.95, 57/327

[56] References Cited

U.S. PATENT DOCUMENTS

| | | | |
|---|---|---|---|
| 1,990,337 | 2/1935 | Lewis et al. | 57/5 |
| 2,208,897 | 7/1940 | Dockerty et al. | 57/5 |
| 2,411,559 | 11/1946 | Sonin et al. | 57/5 X |
| 3,439,491 | 4/1969 | Scruggs | 57/5 |
| 4,107,909 | 8/1978 | Fehrer et al. | 57/58.95 X |
| 4,130,983 | 12/1978 | Dammann et al. | 57/5 |

*Primary Examiner*—John Petrakes

*Attorney, Agent, or Firm*—Scully, Scott, Murphy & Presser

[57] ABSTRACT

A process and arrangement for the covering of a spinning carrier or foundation, in particular yarn, threads, filaments with fiber material, in particular wool, cotton, synthetic fibers, in which the spinning carrier is pulled past a collector drum for the fiber material at a spacing therefrom and into rotation. As the collector drum there is directly employed the pickup of a carding device, and the spinning carrier is pulled past in an axial direction at a distance from the surface of a pickup carrying the fiber nap of the fiber material.

3 Claims, 2 Drawing Figures

PROCESS AND ARRANGEMENT FOR THE COVERING OF A SPINNING CARRIER WITH FIBER MATERIAL

BACKGROUND OF THE INVENTION

1. Field of the Invention

The present invention relates to a process for the covering of a spinning carrier or foundation, in particular yarn, threads, filaments with fiber material, in particular wool, cotton, synthetic fibers, in which the spinning carrier is pulled past a collector drum for the fiber material at a spacing therefrom and into rotation, whereby, as the collector drum there is directly employed the pickup of a carding device, and the spinning carrier is pulled past in an axial direction at a distance from the surface of a pickup carrying the fiber nap of the fiber material. Furthermore, the invention relates to an arrangement for the covering of a spinning carrier with fiber material.

2. Description of the Prior Art

A spinning head for effectuation of a process of this type has already become known, for example, from German Published patent application No. 1,004,085 wherein in a described embodiment, there is also described the covering or spinning about of an endless thread. Together with the rotating collector drum which is constructed as a porcupine roll, which can also be directly the pickup of a carding device, a roller support runs thereabout in conjunction with deflector hoods arranged thereon and which travel against the collector drum. For the spinning about of an endless thread, the deflector hooks serve as a thread guidance slit for the endless thread which is pulled past the collector drum in the axial direction thereof. The thread travels in accordance with the present construction of the deflector hook, over the circumferential surface of the collector drum and is thus spun about with the so taken up fibers in a known manner, apparently through a real rotation. The possibility of the production of a fleecy spun material is not ascertainable.

Known from German Laid-open patent application No. 2 444 813 is the conveyance of a spinning carrier tangentially past the surface of a grooved roll, whereby the groove of the grooved roll has the fiber material which is to be spun about the spinning carrier conveyed thereto from rolls through the intermediary of a blower and/or vacuum. The spinning carrier is set into rotation in order to spread the already thereon applied fibers and then positioned against a twisting spindle. The rotation of the spinning carrier exerts no influence on the pickup of the fiber material from the grooved roll.

Also known from German Laid-open patent application No. 20 65 441 is the manufacturing process of a rayon fiber yarn with the introduction of individual fibers. Hereby, free fibers, with the medium of pressurized air in a mixing chamber twisting element are conveyed to a spinning carrier which is set into mock rotation through the latter.

SUMMARY OF THE INVENTION

Accordingly, it is an object of the present invention to, in a simple manner, fleecingly cover or spin about a spinning carrier having the shape of a yarn, thread, filament or the like, with a fiber material, and to be thereby able to build up the covering of the spinning carrier in different layers.

The foregoing object is inventively achieved through a process of the above-mentioned type in which the spinning carrier is set into such a rapid rotation by means of a tenter producing a false rotation and which is arranged behind the pickup in the direction of movement of the spinning carrier, so that its surface speed is higher than a peripheral speed of the collector drum. Due to the higher surface speed of the spinning carrier in comparison with that of the collector drum which forms the pickup, the fiber material which is combed in the carding device to a fiber nap is plucked from the collector drum and positioned about the spinning carrier. The plucking of the fiber materials from the collector drum is effected in succession as the spinning carrier passes along the longitudinal axis of the collector drum so that the covering or spinning about of the spinning carrier can be built-up in different layers, in accordance with what type of fiber material stands available in which region of the collector drum. Thus, the spinning carrier can be initially coated with a first fiber material and thereafter, in the same work step, coated with a second fiber material. Also colored mottled effects can be simply produced in this manner.

In an advantageous embodiment of the inventive process, there can be adjusted the distance of the spinning carrier from the surface of the collector drum. As a result it is possible to select the volume, in essence, the fleeciness of the spun about fiber material. The larger the distance of the spinning carrier from the surface of the collector drum, the more loosely will the fiber material wind itself about the spinning carrier, and the resultant spun material will become more fleecy. Concurrently, the spacing finger for the adjustment of the distance of the spinning carrier from the collector drum, pursuant to the hereinbelow described arrangement, will exert an influence over the rotation of the spinning carrier. The more the spacing finger displaces the spin carrier from its linear path of movement, then the less extensively will there propagate the false direction of rotation of the spinning carrier, and also through this it is possible to faciliate within wide bounds a variation of the fiber material which is taken off from the collector drum.

An arrangement having a collector drum and a lead-in eyelet for the spinning carrier arranged ahead of the collector drum in the path of movement of the spinning carrier, is equipped for the effectuation of the process with a fly-frame tenter located behind the collector drum in the direction of movement of the spinning carrier including a fly-frame axle and fly-frame eyelet arranged on the free end of a fly-frame arm, as well as a counter eyelet and an adjustable spacing finger located intermediate the pickup and fly-frame, and which finger contacts against the spinning carrier and is adjustable transverse to the direction of the movement of the spinning carrier.

The spinning carrier which is held by the lead-in eyelet and which is axially conducted past the surface of the pickup carrying the nap of the fiber material, after it has been loosely wound about by the fiber material, thereafter passes the spacing finger, the fly-frame axle, the fly-frame eyelet, and the counter eyelet. The operative effect of the spacing finger has already been previously mentioned. The fly-frame tenter forces a false rotation on the spinning carrier intermediate the feed-in eyelet and the counter eyelet. As a consequence, a special effect has been uncovered that, through the movement of the spinning carrier which is loosely wound about by the fiber material relative to the fly-frame eyelet and the counter eyelet, these will envelop the heretofore only loosely wound-about spinning carrier in a spirally-shape with fibers from the spun about fiber material. These spirally-shaped wound fibers actually form an endless spiral which more or less binds the covering about the spinning carrier. Hereby, the binding depends, for example, upon the speed of rotation of the fly-frame tenter, the tension of the spinning carrier, the take-off speed, and the like. After passing the counter eyelet, the rotation of the covered spinning carrier will again spring back. The previously reversed covering bellows between the individual spiral locations and thus imparts a particularly fleecy surface to the product.

BRIEF DESCRIPTION OF THE DRAWINGS

Reference may now be had to an exemplary embodiment of an inventive arrangement for the covering of a spinning carrier with fiber material, taken in conjunction with the accompanying drawings, in which.

DETAILED DESCRIPTION

Figure 1:
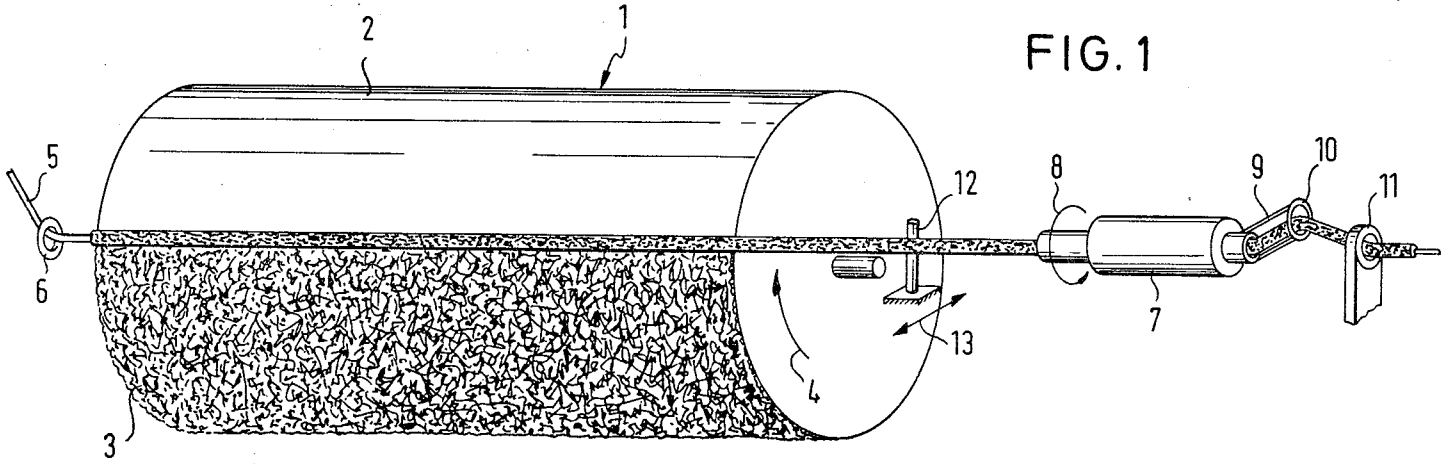
FIG. 1 is a generally schematic view of an arrangement pursuant to the invention.

The pickup 1, in essence, the last roll or drum of a carding device (not described in detail) carries on its surface 2 the nap of fiber material 3. The direction of rotation of the pickup 1 is indicated by the arrow 4. The spinning carrier 5 is held at one side of the pickup 1 by a lead-in eyelet 6 and, at the other side of the pickup 1, is conveyed through the hollow axle of the fly-frame tenter 7, the drive of which is not illustrated, of which one of its two possible directions of rotation is, however, also indicated by the arrow 8. A fly-frame eyelet 10 is provided on a fly-frame arm 9 which rotates in conjunction with the fly-frame tenter 7, which lies outside of the direction of the spinning carrier and, through its rotation, imparts a rotation to the spinning carrier. The counter eyelet is identified by reference numeral 11. The spinning carrier is pulled along in the axial direction of the pickup 1 past the surface 2 thereof in a direction from left to right. The means which facilitate the pulling of the spinning carrier past the pickup are known and are not illustrated herein.

Located intermediate the fly-frame tenter 7 and the pickup 1 is a spacing pin 12 which lies against the side of the spinning carrier 5 and which, through the intermediary of known means not shown herein can be adjusted and set in a direction of the arrow 13, so that the spinning carrier 5 can be more or less forced out of its direction of movement and thereby adjusted the spacing thereof relative to the surface 2 of the pickup 1. Concurrently, the spacing pin 12 provides the effect, depending on how far it forces the spinning carrier 5 from its direction of movement, that the rotation which is formed by the fly-frame tenter 7 can be adjustably propagated more or less over the region of the spinning carrier lying opposite the surface 2. In this manner it is possible to vary the quality, in particular the fleecyness of the obtained spun-covered goods within wide bounds.

Figure 2:
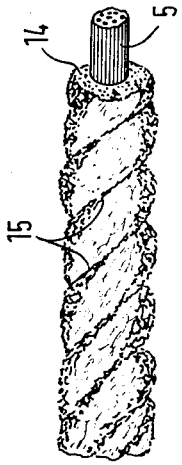
FIG. 2 is a generally schematic view of a piece of a product produced through the inventive process.

In the product according to FIG. 2, the spinning carrier is designated by reference numeral 5, the fleecy spun covering by 14, and the spirally-shaped enveloping from the spun about fiber material by reference numeral 15.

What is claimed is:

1. In a process for the spin-covering of a spinning carrier, particularly yarn, threads or filaments, with a fiber material, particularly wool, cotton or synthetic fibers, including pulling said spinning carrier at a distance past a collector drum for the fiber material and setting said spinning carrier into rotation, said collector drum being the pickup of a carding device and the spinning carrier being pulled in an axial direction past and at a distance to the surface of a pickup supporting the fiber nap of the fiber material, the improvement comprising: imparting a so rapid rotation to said spinning carrier by a fly-frame tenter arranged behind the pickup in the direction of movement of said spinning carrier and generating a false rotation whereby the surface speed of said spinning carrier is higher than the circumferential speed of said collector drum.

2. Process as claimed in claim 1, comprising adjusting the distance between said spinning carrier and the surface of said collector drum.

3. In an arrangement for the spin-covering of a spinning carrier, particularly yarn, threads or filaments, with a fiber material, particularly wool, cotton or synthetic fibers, including a collector drum being the pickup of a carding device, said spinning carrier being pulled past said pickup at a distance therefrom, the improvement comprising: a fly-frame tenter located behind said collector drum in the direction of movement of said spinning carrier, said fly-frame tenter including a fly-frame axle, a fly-frame arm, and a fly-frame eyelet arranged on the free end of said arm, a counter eyelet, and a spacing finger located intermediate the pickup and the fly-frame tenter, said spacing finger lying against said spinning carrier and being adjustable transverse to the direction of movement of said spinning carrier.

* * * * *